US005452488A

United States Patent [19]

Reinhardt

[11] Patent Number: 5,452,488

[45] Date of Patent: Sep. 26, 1995

[54] CONTOURABLE POCKET FOAM MATTRESS AND METHOD OF MANUFACTURE

[75] Inventor: Paul W. Reinhardt, Sunderland, Canada

[73] Assignee: Perma Foam Limited, Scarborough, Canada

[21] Appl. No.: 27,089

[22] Filed: Mar. 5, 1993

[51] Int. Cl.[6] ..... A47C 27/00

[52] U.S. Cl. ..... 5/464; 5/481; 5/901

[58] Field of Search ..... 5/464, 481, 900.5, 5/901

[56] References Cited

U.S. PATENT DOCUMENTS

| | | | |
|---|---|---|---|
| 1,887,310 | 11/1932 | King . | |
| 1,980,445 | 11/1934 | Sherover . | |
| 2,619,659 | 12/1952 | Futterknecht . | |
| 2,768,924 | 10/1956 | Wright . | |
| 2,859,455 | 11/1958 | Koenigsberg . | |
| 2,953,195 | 9/1960 | Turck, jr. . | |
| 2,995,778 | 8/1961 | Hill . | |
| 3,064,279 | 11/1962 | Findle . | |
| 3,133,853 | 5/1964 | Knox . | |
| 3,553,068 | 1/1971 | Coale | 5/481 |
| 3,553,748 | 1/1971 | Ross . | |
| 3,885,257 | 5/1975 | Rogers | 5/900.5 |
| 3,940,811 | 3/1976 | Tomikawa et al. . | |
| 3,974,532 | 8/1976 | Ecchuya | 5/901 |
| 4,276,666 | 7/1981 | Yamada | 5/481 |
| 4,383,342 | 5/1983 | Forster | 5/900.5 |
| 4,603,445 | 8/1986 | Spann . | |
| 4,686,724 | 8/1987 | Bedford . | |
| 4,700,447 | 10/1987 | Spann . | |
| 4,768,251 | 9/1988 | Baskent . | |
| 4,809,374 | 3/1989 | Saviez | 5/900.5 |
| 4,999,868 | 3/1991 | Kraft | 5/464 |
| 5,035,017 | 7/1991 | Komuro | 5/481 |
| 5,052,068 | 10/1991 | Graebe et al. | 5/464 |
| 5,153,956 | 10/1992 | Nold | 5/481 |
| 5,163,196 | 11/1992 | Graebe et al. | 5/464 |

FOREIGN PATENT DOCUMENTS

| | | | |
|---|---|---|---|
| 1176577 | 11/1958 | France | 5/481 |
| 1244182 | 9/1960 | France | 5/481 |
| 701433 | 2/1966 | Italy | 5/481 |
| 1310373 | 3/1973 | United Kingdom | 5/481 |

OTHER PUBLICATIONS

ER Carpenter Company–Iris Preventix Modular Pressure Relief Mattress, Copyright 1991.

*Primary Examiner*—Michael J. Milano
*Attorney, Agent, or Firm*—Michael N. Meller

[57] ABSTRACT

A foam mattress made up of a number of segments each of which includes a sheet-like base member and a plurality of discrete spaced apart foam elements extending from a face of the base member wherein the elements have been integrally formed in a single molding operation along the base member. The segments are joined to one another at their respective bases to form a core from which the elements extend from opposite sides.

3 Claims, 3 Drawing Sheets

CONTOURABLE POCKET FOAM MATTRESS AND METHOD OF MANUFACTURE

FIELD OF THE INVENTION

This invention relates generally to foam articles and their methods of manufacture and more particularly to foam mattresses having a plurality of individual resilient elements.

BACKGROUND OF THE INVENTION

Resilient mattresses may generally be classified into two broad categories based on the components which give resiliency to the mattresses, namely coil spring mattresses and foam mattresses.

A coil spring mattresses generally comprises many coil springs extending between upper and lower mattress faces to support the upper and lower faces. In better quality coil spring mattresses, each spring may be compressed a different amount, depending on the load placed on the adjacent mattress face to contour around the load and give relatively even support. It is possible also to use springs having different stiffnesses in different areas of the mattress to better enable the mattress to contour around an irregularly shaped load.

A problem which must be contended with in coil spring mattresses is preventing the coils of adjacent springs from interlocking with one another causing some of the coils to bind rather than restoring themselves to uncompressed height. One method which is commonly used in the industry to prevent such interlocking is to encapsulate each coil in a separate fabric pouch to alleviate the tendency of the coils to interlock. Such encapsulation however adds greatly to the cost of manufacturing a mattress because of the labour and material involved in encapsulating the numerous springs.

Foam mattresses are lightweight and more efficiently manufactured manufacture as compared to coil spring mattresses. Foam mattresses are generally made from an elastomeric material which is initially in a liquid state and is treated in such a way as to evolve gas which causes the material to expand by foaming to form a resilient spongy mass that either sets on its own or requires some subsequent curing step.

The most basic foam mattress is essentially a block of foam which has generally consistent "stiffness" throughout and wouldn't deform in discrete areas in the manner described above for the better quality coil spring mattresses.

The traditional method for texturing the surface of a foam article involves a cutting operation wherein pressure is applied to region of a foam block from opposite sides to compress the foam in the region. The compressed foam is subjected to a transverse cut such as with a band-saw blade. This method divides the foam block into two components with the compressed regions becoming recessed areas when the pressure is removed. This particular method is relatively inefficient both in terms of the amount of machining required and the waste of material. This method also leaves an exposed "cut" surface rather than the "skin" which would ordinarily cover the surface of a foam article as a result of a molding operation. Cutting through the skin reduces the durability of the foam article and yields a surface more prone to frictional binding with another cut surface than would be the case with two uncut surfaces.

Previous attempts have been made to manufacture a foam mattress having individual resilient elements. In one particular mattress, the foam elements are cut into individual blocks and adhered to both sides of a grid-like substrate. Although such a mattress may substantially replicate the comfort of a good quality coil spring mattress, its manufacture is extremely labour intensive. Furthermore in view of the fact that the individual elements are cut and therefore have cut faces, substantial inter-element friction results which affects the ability of the mattress to restore itself to a generally rectangular overall configuration when a load is removed.

It is an object of the present invention to provide a foam mattress having a plurality of discrete spaced apart foam elements to give contourability analogous to a quality coil spring mattress having individual coil springs encapsulated in respective pouches.

It is a further object to the present invention to provide a foam mattress having individual foam elements without excessive friction between the elements thereby allowing the elements to have good restorative capabilities.

A still further object of the present invention is to provide a foam mattress as described above which is more efficient to manufacture as compared to coil spring type mattresses and previous foam element mattresses.

It is yet a still further object of the present invention to provide a foam mattress construction which has zones of different firmnesses selected to correspond to the nature of the load to be supported thereupon.

It is also an object of the present invention to provide a method of making segments which may be incorporated into a foam mattress as described above in which the discrete spaced apart foam elements are molded integrally therewith rather than cut from a foam block.

SUMMARY OF THE INVENTION

A segment for a foam mattress comprising: a sheet-like base member; a plurality of discrete spaced apart foam elements extending from a face of said base member; and wherein said elements are integral with and have been formed by molding along with said base member;

A mattress comprising a plurality of segments as described above wherein said segments are joined to one another at their respective bases to form a transversely extending core from which said elements extend from opposite sides.

A method of making a segment for a foam mattress, said method utilizing a mold having a plurality of spaced apart non-diverging cavities extending generally perpendicularly into a base sheet, said method including the steps of:

(a) coating said mold with a suitable release agent;

(b) injecting a material which expands by foaming to yield a resilient spongy mass (individually?) into each said cavity;

(c) allowing said material to expand to generally conform to the shape of said mold;

(d) taking any necessary steps to cure said foamed material; and (e) stripping said cured and foamed material from said mold to yield said segment.

BRIEF DESCRIPTION OF THE DRAWINGS

The invention will be described in more detail below with reference to the accompanying drawings in which.

DETAILED DESCRIPTION OF THE INVENTION

Figure 1:
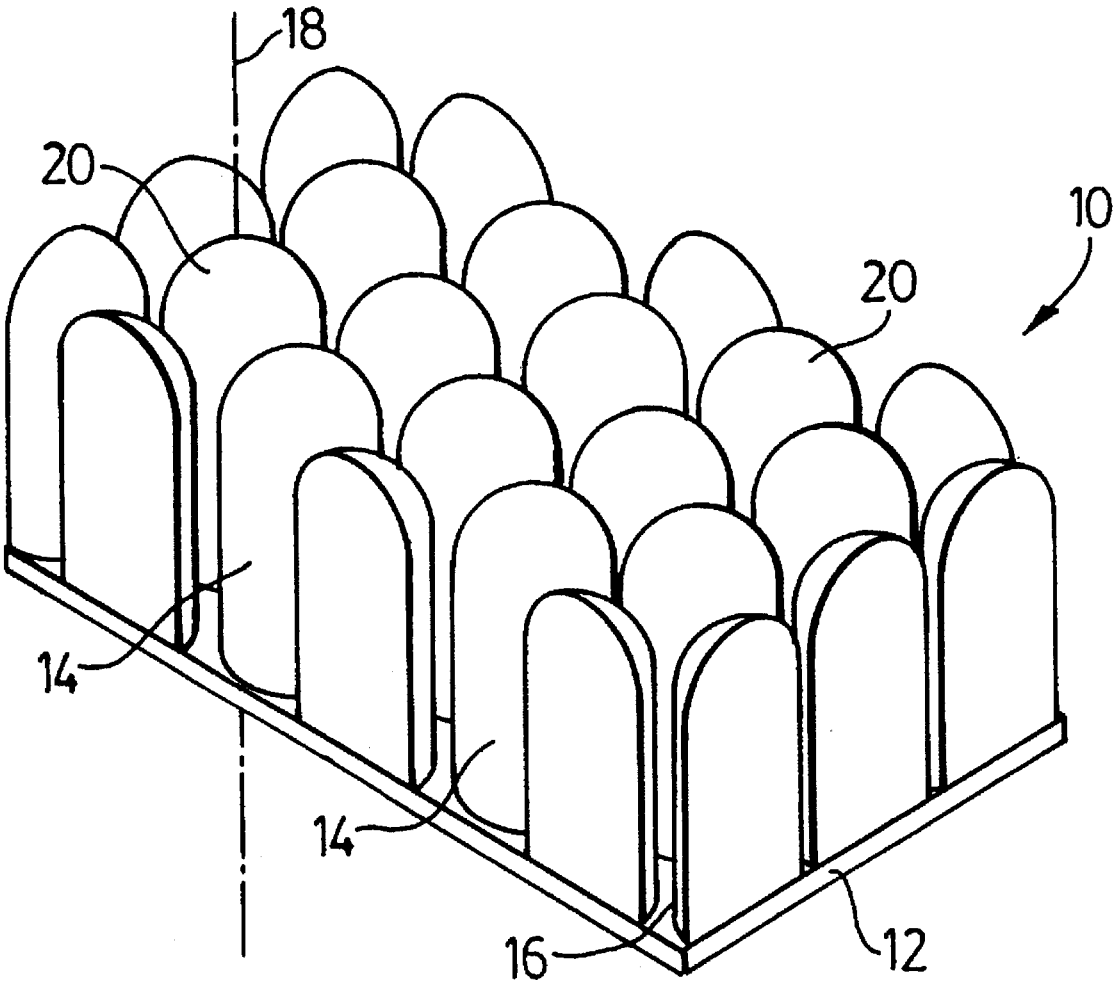
FIG. 1 is an isometric view of a segment according to the present invention.
Figure 2:
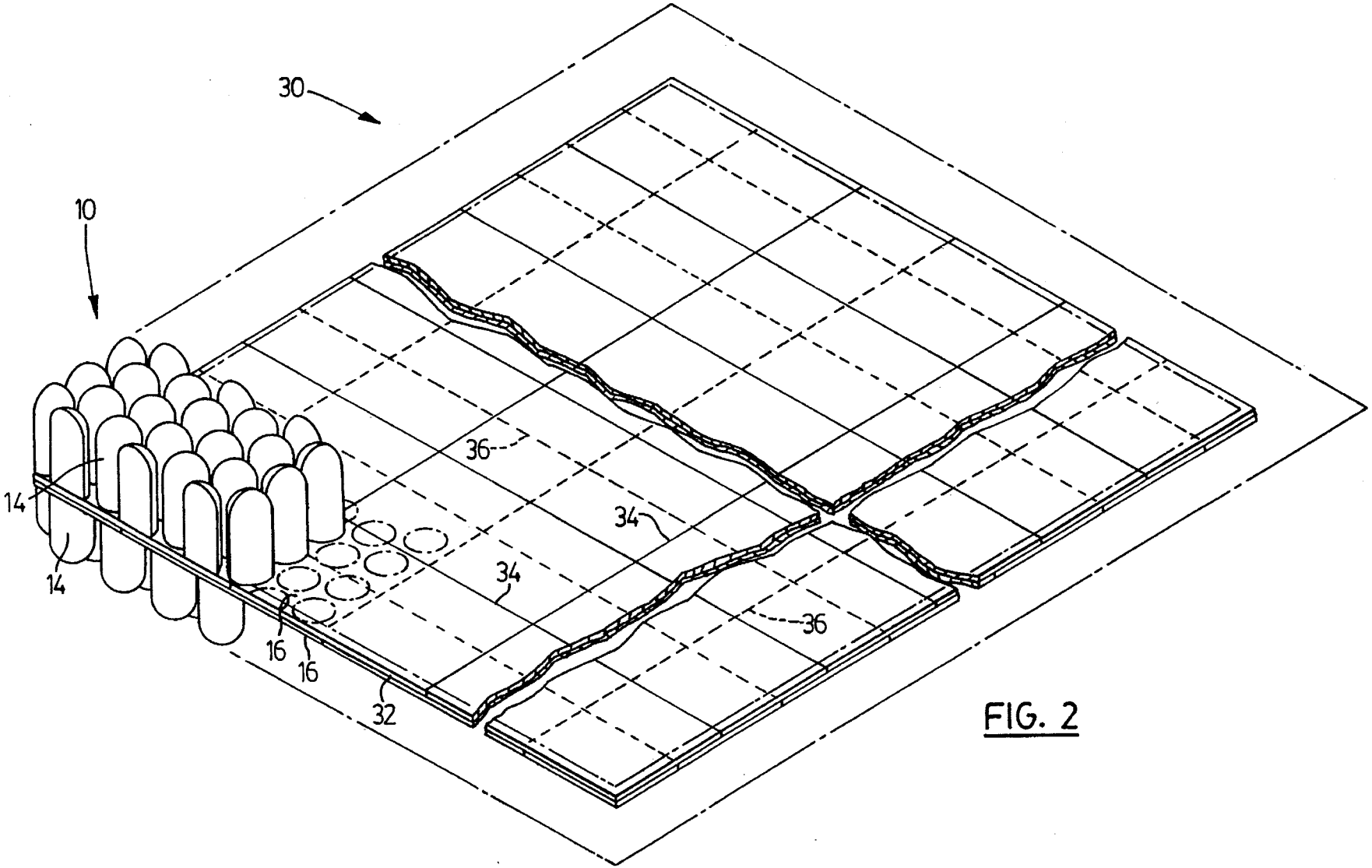
FIG. 2 is an isometric view of a foam mattress according to the present invention.

A segment for a foam mattress is generally indicated by reference 10 in FIGS. 1 and 2. Each segment includes a sheet-like base member 12 and a plurality of discrete spaced apart foam elements 14 which extend from a face 16 of the base member 12. Each of the elements 14 is shown as being generally cylindrical having a longitudinal axis 18 and a rounded or hemispherical end 20.

The foam elements 14 illustrated generally have a cylindrical shape with rounded ends as it has been found that this particular configuration yields a foam mattress having suitable properties and is relatively easy to manufacture. It is however conceivable that other geometric shapes may be used which have either generally parallel or tapered sides to facilitate removal from a mold. Accordingly, any reference to "generally cylindrical" or "parallel sided" shapes for the foam elements herein should be interpreted broadly enough to include any suitable shape readily manufacturable according to the method described herein.

As described in more detail below, the segments 10 and base member 12 are formed in the same molding process to yield an integral structure. Although various foamable materials may be suitable for producing segments according to the present invention, it has been found that polyurethane foam works well in the present process and yields a segment having suitable properties.

A foam mattress according to the present invention is generally indicated in FIG. 2 by reference 30. The foam mattress 30 consists of a number of segments 10 as generally described above joined to one another at their respective bases 12 to form a transversely extending core 32 from which the individual foam elements extend from opposite sides. Any suitable joining means may be used such as adhesives or fusion.

The elements 10 on the top side of the mattress 30 illustrated in FIG. 2 have transverse seams 34 between them. The elements 10 on the underside of the mattress 30 in FIG. 2 have transverse seams 36 between them. Preferably the segments 10 are joined so that the transverse seams 34 on the top side do not lie on top the transverse seams 36 on the bottom side. In this manner is not necessary to join the elements 10 at their transverse seams 34 or 36 and also, any lateral force applied to the mattress may be absorbed by the bases 12 of the elements 10 in the core 32 rather than the transverse joints 34 or 36 between the elements 10.

To optimize the comfort of a mattress 30 according to the present invention, segments 10 manufactured from different foams or foams of different densities may be incorporated. In such a structure, different zones of the mattress (each zone corresponding to the area of an element 10) would deform in a particular manner characteristic of the material selected.

Figure 3:
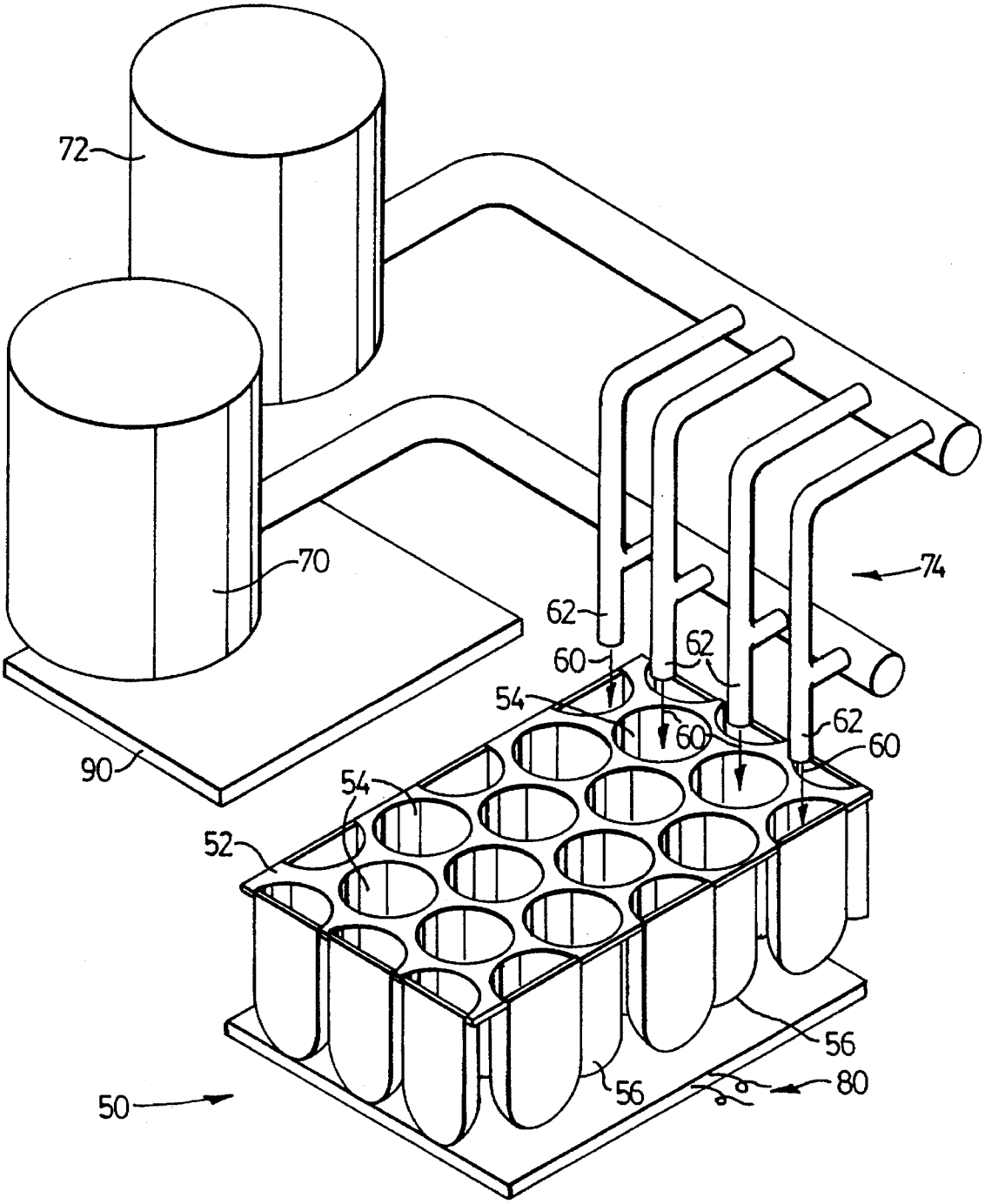
FIG. 3 is pictorial view of a process for making a segment according to the present invention.

FIG. 3 illustrates a method of manufacturing a segment such as the segments 10 in FIGS. 1 and 2. The method utilizes a mold 50 having a base sheet 52 into which extend a plurality of cavities 54. The cavities 54 are illustrated as being generally cylindrical having rounded ends 56. It has been found that a cavity of this shape has good properties with respect to stripping of the foam article therefrom. To further facilitate stripping, a slight taper of the cavities 56 away from the face sheet 52 may be incorporated in the mold 50. No doubt shapes other than cylindrical may be employed. Preferably the cavities will be parallel sided or converge away from the base sheet 52 and will lack any bulges which might trap material and make it difficult or impossible to strip the finished article from the mold 50.

The first step in the manufacturing process, if required by the foaming material selected, is to coat the mold with a suitable release agent. Next a material indicated by reference 60 which expands by foaming to yield a resilient spongy mass is introduced into each of the cavities 54 via a suitable nozzle 62. The nozzles 62 may be high pressure mix heads in which suitable components are combined to yield the material 60. FIG. 3 illustrates a first container 70 and a second container 72 each of which may be used to store a different component of the material 60. The components are fed from the containers 70 and 72 to the nozzles 62 through suitable fluid conduit means such as the pipping illustrated generally by reference 74. The polyol compound would typically be a blend of polypropylene oxide and ethylene oxide. The isocyanate would typically be toluene di-isocyanate. The mold may be heated prior to filling by any suitable means such as for example element 80 schematically illustrated at the bottom of FIG. 3.

Once the mold has been filled, a lid 90 is placed over the top of the mold 50 and the mold is closed and locked for a period of time sufficient to cure the foam resulting from the expansion of the material 60. Once the foam segment has cured, it may be stripped from the mold and crushed to open the cells in the foam to reduce subsequent shrinkage.

An advantage of the present invention is that it yields a foam mattress having individual foam elements generally analogous to a coil spring mattress with encapsulated springs. As the foam article is not machined, the skin which results from contact with mold face is not disturbed thereby enabling the elements to move relative to one another without excessive binding. The foam elements 18 may deform both axially by compression along the respective axes 18 or laterally by bending transverse to the relative axes 18. In view of the costs of the raw materials and the elimination of the need to individually encapsulate each foam element 18, the cost of producing a foam mattress 30 according to the present invention is significantly less than that to produce a coil spring type mattress having similar characteristics.

It is intended that the above description be interpreted in an illustrative rather than in a restrictive sense as variations may be apparent to those skilled in the art without departing from the spirit or scope of the invention which is defined in the claims set out below.

I claim:

1. A mattress comprising a plurality of segments with each segment comprising:

an integrally molded sheet-like base member having two sides and a plurality of discrete foam elements extending from one side thereof with their axes in substantial parallel alignment in a direction generally perpendicular to said base member;

wherein each of said foam elements has an outer skin resulting from contact with the mold face during the molding operation and lie substantially contiguous to one another and wherein said plurality of segments are joined to one another at their respective bases with each segment having a complementary segment on the opposite side with the base of each in common such that a plurality of said foam elements extend from opposite sides thereof and with said segments joined so that the transverse seams on one side are out of alignment with the transverse seams on the opposite side.

2. A mattress comprising a plurality of segments with each segment comprising:

an integrally molded sheet-like base member having two sides and a plurality of discrete foam elements extending from one side thereof with their axes in substantial parallel alignment in a direction generally perpendicular to said base member;

wherein each of said foam elements has an outer skin resulting from contact with the mold face during the molding operation and lie substantially contiguous to one another and wherein said segments are joined one to another at their respective bases to form a transversely extending core with each segment having a complementary segment disposed on the opposite side with the base of each in an overlapping relationship such that the foam elements of the segments extend from the opposite sides of the mattress and wherein some of said segments have a stiffness which is different than the stiffness of the remaining of said segments to give said foam mattress zones of different stiffness and wherein at least some of the adjacent edges of said segments on one side of said core do not run along the adjacent edges of the corresponding segments on the opposite side of said core.

3. A mattress comprising a plurality of segments with each segment composed of a sheet like base member having two sides and a plurality of discrete foam elements extending from one side thereof formed from a process comprising molding the base member and foam elements from a single mold containing cavities filled with a material which expands by foaming to form said discrete elements integral with the base member in one molding operation with each discrete element having an outer skin resulting from contact with the mold face during the molding operation and with said plurality of segments being joined to one another to form a transversely extending core with each segment having a complementary segment positioned on opposite sides with the base of each in common such that the foam elements of such segments extend from opposite sides of the mattress and wherein said plurality of segments are joined together to form transverse seams on each opposite side thereof which are not in relative alignment.

* * * * *